US005095582A

United States Patent [19]

Ohlsson

[11] Patent Number: 5,095,582

[45] Date of Patent: Mar. 17, 1992

[54] HINGE ARRANGEMENT FOR ATTACHING HINGED PARTS

[75] Inventor: Dick Ohlsson, Trollhättan, Sweden

[73] Assignee: Saab Automobile Aktiebolag, Sweden

[21] Appl. No.: 566,414

[22] PCT Filed: Dec. 27, 1989

[86] PCT No.: PCT/SE89/00749

§ 371 Date: Aug. 21, 1990

§ 102(e) Date: Aug. 21, 1990

[87] PCT Pub. No.: WO90/07622

PCT Pub. Date: Jul. 12, 1990

[30] Foreign Application Priority Data

Dec. 28, 1988 [SE] Sweden ..... 8804667-7

[51] Int. Cl.[5] ..... E05D 11/00

[52] U.S. Cl. ..... 16/235; 16/254; 16/270; 296/106; 296/146

[58] Field of Search ..... 16/235, 251, 254, 382, 16/270, 387, 223, 237, 249, 383, 384; 411/103, 389; 296/106, 146

[56] References Cited

U.S. PATENT DOCUMENTS 4,619,016 10/1986 Brockhaus .
4,908,908 3/1990 Mitsuoka et al. ..... 16/270

FOREIGN PATENT DOCUMENTS 767777 6/1953 Fed. Rep. of Germany ..... 411/389
2553848 6/1977 Fed. Rep. of Germany .
1367663 6/1964 France ..... 16/270
1518049 7/1978 United Kingdom .
2058903 4/1981 United Kingdom .

*Primary Examiner*—Richard K. Seidel
*Attorney, Agent, or Firm*—Ostrolenk, Faber, Gerb & Soffen

[57] ABSTRACT

In a hinge (4) between a fixed part (3) and a movable part (1), the pivotable hinge part (6) has a guide device (7) by means of which the movable part can be fixed on the hinge in a desired position relative to this and the fixed part. The movable part can then be detached from the hinge together with the guide device and can then, by means of the guide device, be guided back to the previous position when remounting takes place.

23 Claims, 2 Drawing Sheets

HINGE ARRANGEMENT FOR ATTACHING HINGED PARTS

Figure 1:
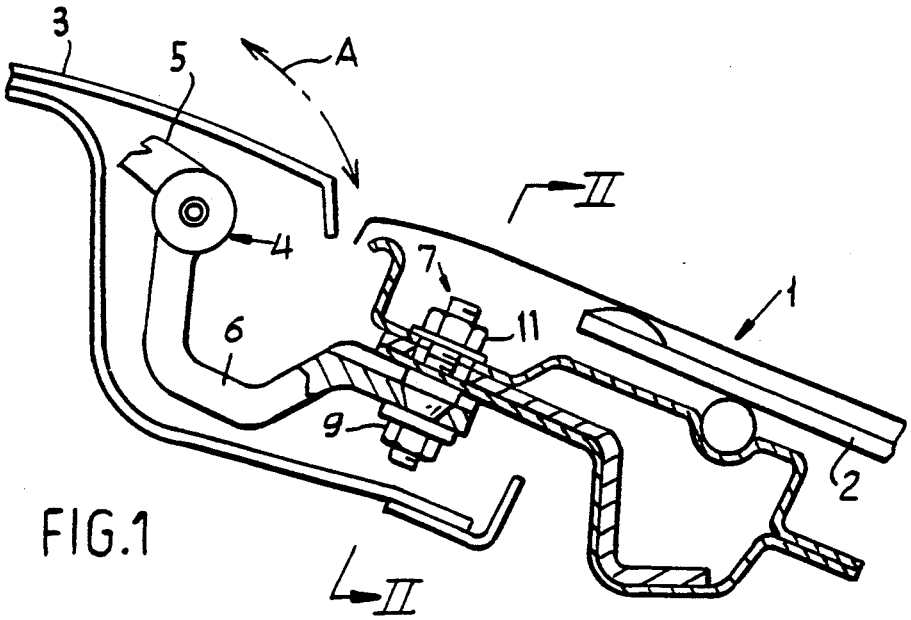

The present invention relates to a hinge arrangement for pivotable suspension of a moveable part on a fixed part, particularly for suspension of a door or hatch on the body of a motor vehicle, which arrangement comprises at least one guide device by means of which the moveable part, after it has been dismounted from the fixed part, can be remounted in a position set before dismounting.

In car manufacturing it is desirable to be able to fit doors and hatches in the correct position on the vehicle body in the body production shop. However, this makes it difficult to carry out subsequent assembly work on these doors and hatches, and also on the vehicle body itself. It is therefore desirable, in final assembly, to be able to dismount the doors and hatches, especially luggage space hatches of the estate car type, in order to facilitate various assembly work. This makes it considerably simpler to provide the doors and hatches with locks, glass etc. Remounting of these doors and hatches in the finished state has, however, caused certain problems, since it has been necessary to carry out a new and time-consuming fitting.

It is true that it has been possible to use colour markings, for example, to obtain a good idea of how the parts should be positioned relative to each other in order to fit well, but the accuracy has been imperfect.

The aim of the invention is to permit, by simple means, a simple and accurate remounting of a previously mounted moveable part such as, for example, a hatch or a door on a fixed part such as, for example, a vehicle body.

This is achieved according to the invention in that the guide device connects the moveable part to that hinge part which is designed to be pivotable. The guide device is detachably connected to the hinge part in a fixed position relative to this and, thus, also in a fixed position relative to the fixed part. The moveable part can be fixed relative to the guide device in a desired position relative to this for the purpose of achieving a set position of the moveable part relative to the guide device. The guide device can be dismounted together with the moveable part and has a guide member cooperating with the hinge, by which means the guide device together with the moveable part can be guided to and remounted in the previously set position. In this way the moveable part can be arranged simply and very quickly in the correct position relative to the hinge and fixed on this without special fitting.

An alternative embodiment of the invention to which this application relates is distinguished in that the guide device connects the hinge part, which is designed not to be pivotable, to the fixed part, so that the guide device is detachably connected to the fixed part in a fixed position relative to the latter. The hinge can be fixed relative to the guide device in a desired position relative to the latter for the purpose of achieving a set position of the hinge relative to the guide device. The guide device can be dismounted together with the hinge and has a guide member cooperating with the fixed part, by which means the guide device together with the hinge can be guided to and remounted in the previously set position.

In this definition of the invention, the parts included in the arrangement are connected to each other in a manner which is essentially the reverse of the previously mentioned embodiment. The advantages which are achieved are, however, essentially the same.

The guide device can advantageously have a first attachment piece which is intended to reach through the pivotable hinge part or alternatively through the fixed hinge part, and which is designed to cooperate with a first attachment member in order to fix the guide device on the pivotable hinge part/fixed hinge part. Furthermore, the guide device can have a second attachment piece which is intended to reach with play through the moveable part or alternatively through the hinge part, which is designed not to be pivotable, and which is designed to cooperate with a second attachment member in order to fix the moveable part on the pivotable hinge part/fixed hinge part. The guide device can in this way be given a simple design and can be mounted and dismounted quickly and simply.

Figure 2:
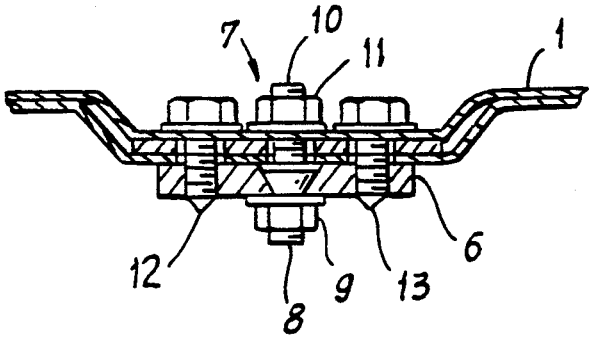
Figure 3:
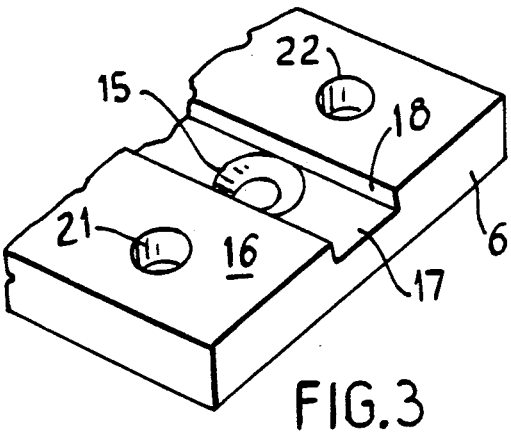
Figure 4:
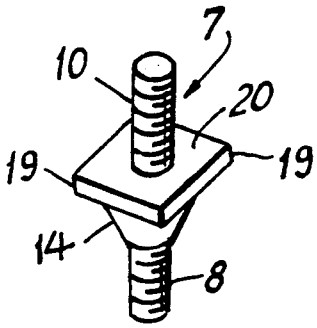
Figure 5:
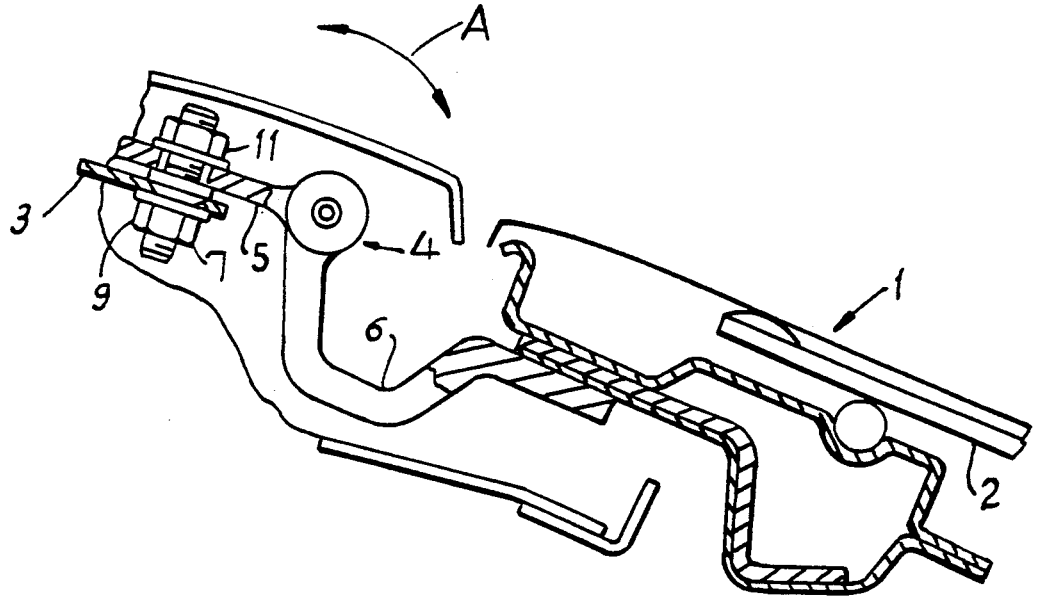

The invention is illustrated in greater detail below on the basis of an exemplary embodiment shown in the attached drawing, in which:

FIG. 1 shows, partially in section, a first embodiment of a hinge arrangement designed according to the invention, FIG. 2 shows a section II—II in FIG. 1, FIG. 3 shows a piece of the pivotable hinge part, FIG. 4 shows a guide device cooperating with the hinge part in FIG. 3, and FIG. 5 shows, partially in section, a second embodiment of a hinge arrangement designed according to the invention.

According to FIG. 1, a moveable part 1 in the form of a rear hatch of the estate car type, provided with a window 2, is pivotably suspended on a fixed part 3 in the form of a vehicle body, with the aid of at least two hinges 4, of which only one is shown in the drawing. Each hinge has a hinge part 5 designed in a conventional manner for fixation in the fixed part 3, and a hinge part 6 which is pivotable relative to the hinge part 5 and constitutes the attachment for the moveable part 1.

At the free end of the pivotable hinge part 6 there is mounted a guide device 7 which includes a first downwardly projecting attachment piece 8, and reaches through the pivotable hinge part 6 and is secured in the part 6 by means of a first attachment member 9 (FIG. 2). By means of a second upwardly projecting attachment piece 10, the guide device 7 reaches with play through the moveable part 1 which, by means of a second attachment member 11 cooperating with the second attachment piece 10, is fixed with respect to the pivotable hinge part 6. Attachment devices 12 and 13 in the form of screws on either side of the guide device 7 run with play through the moveable part 1 and are in engagement with the pivotable hinge part 6 in order to further fix the moveable part 1 with respect to the pivotable hinge part 6.

The guide device 7 is here designed as a pin bolt which is threaded at both ends and which has, in its first attachment piece 8 cooperating with the pivotable hinge part 6, a conical cutting 14 for cooperation with a corresponding conical recess 15 in the pivotable hinge part 6 (FIGS. 3 and 4). The conical recess 15 has its base directed towards the side 16 of the pivotable hinge part 6 against which the moveable part 1 is intended to bear.

In the pivotable hinge part 6 there is a groove 17 with side walls 18 with which edge surfaces 19 (FIG. 4) of a locking part 20 arranged in connection with the conical part 14 of the guide device 7 can cooperate in order to prevent turning of the guide device 7. The top side of the locking part 20 is designed to be level with the side 16 of the pivotable hinge part 6 in order to be able to bear well against the moveable part 1. In the pivotable hinge part 6 there are threaded holes 21 and 22 respectively for each attachment device 12 and 13 respectively.

As emerges from FIGS. 1 and 2, the guide device 7 and the attachment devices 12 and 13 run through the moveable part 1 with so great a play that a certain mutual positional displacement between the moveable part 1 and the pivotable hinge part 6 is possible. This is of considerable importance for the moveable part 1 to be able to be set in the correct position relative to the fixed part 3. However, in this respect it is important that the heads of the screws 12 and 13, like the nut 11 and the locking part 20, or any washers cooperating with these parts, should be large enough to cover the respective openings in the moveable part 1 sufficiently in different positions.

The mounting of the moveable part 1 on the fixed part 3 is carried out in the following manner:

Before mounting of the moveable part 1 takes place, the hinge 4 has been fixed in the fixed part 3 and provided with the guide device 7, which is fixed in the pivotable hinge part 6 by means of the first attachment member 9, in which respect the conical cutting 14 is braced in the recess 15. The second attachment member 11 has not yet been mounted. The moveable part 1 is then fixed with respect to the pivotable hinge part 6 by means of the second attachment member 11 when fitting of the moveable part 1 relative to the fixed part 3 has been carried out. As has been mentioned earlier, the number of hinges can vary, but two is a normal number. The attachment devices 12 and 13 may also be mounted if appropriate.

After fitting, the moveable part 1 can be dismounted simply by means of removing the attachment devices 12 and 13, which may have been mounted, and the first attachment member 9. The guide device is then held in the correct position on the moveable part 1 by means of the second attachment member 11.

Upon remounting of the moveable part, for example in connection with final assembly of a vehicle, the moveable part 1 is guided automatically to the correct position relative to the fixed part 3 by means of its guide device 7 and can be easily fixed by means of the first attachment member 9 and the two attachment devices 12 and 13, in such a way that the moveable part can be pivoted in the direction of the double arrow A (FIG. 1).

By means of using, as has been shown here, a conical recess 15 in the pivotable hinge part 6, the guide device 7 is guided effectively to the correct position when the moveable part 1 is remounted, but it is also possible to have instead, for example, only a pointed end on the first attachment piece 8. Rotational locking of the attachment device 7 can be achieved in other ways than has been shown here, for example by means of some form of locking plate which cooperates with the guide device 7 and with the pivotable hinge part 6. The various attachment members and attachment devices can of course also be varied in number, design and position. Instead of nuts 9 and 11, locking clips can be used for example.

In the exemplary embodiment shown, the moveable part 1 can be set relative to the fixed part 3 in a plane parallel to the hinge axis. However, there is nothing to prevent the arrangement being designed in such a way that setting can take place instead in a plane of other orientation, for example in a plane at right angles to the hinge axis.

In the exemplary embodiment described, the guide member 7 is, as shown in FIG. 1, arranged between the rear hatch 1 and the hinge part 6 which is designed to be pivotable, but it is also possible to arrange the guide member 7 between the hinge part 5, which is designed not to be pivotable, and the body 3 without departing from the concept of the invention. This second embodiment of the invention is shown in FIG. 5. According to FIG. 5, the rear hatch 1 is connected in a fixed manner, in a way not shown in detail, to the hinge part 6 which is designed to be pivotable, while the guide device 7 is mounted on the hinge part 5 which is designed to be fixed on the body 3. The guide device 7 is in this case detachably connected to the body 3, while the hinge part 5 can be fixed in the desired position relative to the guide device 7. In other respects, in the embodiment of FIG. 5, the fixed part 3 has the features of the hinge part 6 in FIG. 1 and the hinge part 5 has the features of the movable part 1 in FIG. 1, in the region of the attachment together of the parts 3 and 5.

In other respects the two embodiments are identical to each other.

I claim:

1. A hinge arrangement for pivotally suspending a movable part on a fixed part;

the hinge arrangement comprising a pivot hinge, a first hinge part extending away from the pivot hinge for being connected to the movable part and a second hinge part extending away from the pivot hinge for being connected to the fixed part;

a guide device for detachably connecting the first hinge part to the movable part in a fixed position relative to the movable part, the guide device being fixable to the movable part in a preset position; while remaining fixed together with the movable part, the guide device being separable from the first hinge part;

the guide device including a guide member, the guide member and the first hinge part having respective formations thereon which enable the guide device together with the movable part to be guided to and remounted on the previously set position on the first hinge part for enabling the movable part to be separated from the fixed part and thereafter to be remounted on the fixed part in a position that had been set before separation.

2. The arrangement of claim 1, further comprising a first attachment piece on the guide device, a first opening in the first hinge part into which the first attachment piece extends; and a first attachment member for cooperating with the first attachment piece for fixing the guide device on the first hinge part.

3. The arrangement of claim 2, further comprising a second attachment piece on the guide device, the movable part having a second opening therein into which the second attachment piece extends, the second attachment piece and the second opening in the movable part being respectively so shaped that there is play between them, permitting lateral shifting of the guide device with respect to the movable part; and a second attachment member for fixing the movable part to the second attachment piece.

4. The arrangement of claim 3, further comprising an additional attachment device for connecting the movable part and the first hinge part, in addition to the guide device.

5. The arrangement of claim 4, wherein the first hinge part has a threaded opening therein, the additional attachment device comprises a screw form device for being screwed into the threaded opening in the first hinge part, and the movable part having an opening therethrough through which the screw form device passes, the opening in the movable part being sized so that the screw form device passes through the movable part opening with play, enabling the movable part to be adjusted with respect to the screw form device and the first hinge part for setting the initial orientation of the guide device with respect to the first hinge part and the movable part.

6. The arrangement of claim 3, wherein each of the first and second attachment pieces comprises a screwthreaded bolt, the respective first and second attachment members comprise a first and a second nut, for respectively cooperating with the first and second bolts.

7. The arrangement of claim 3, wherein the first attachment piece has further defined on it the guide member including the formation for guiding the guide device onto a predetermined fixed position on the first hinge part, and the first hinge part having the formation thereof in the form of a recess therein in which the guide member of the first attachment piece is received for fixing the guide device and the first hinge part in fixed relative positions.

8. The arrangement of claim 7, further comprising rotation orientation means on the guide device and on the first hinge part for rotationally fixing the orientation of the guide device with respect to the first hinge part.

9. The arrangement of claim 7, wherein the recess in the first hinge part comprises a conical recess which opens wider toward the one side of the hinge part toward which the guide device is disposed and the guide member formation comprises a conically shaped part for being received in the conical recess for orienting the guide device with respect to the first hinge part.

10. The arrangement of claim 9, wherein the movable part bears against the one side of the first hinge part when the guide device is secured to the first hinge part.

11. The arrangement of claim 9, further comprising rotation orientation means on the guide device and on the first hinge part for rotationally fixing the orientation of the guide device with respect to the first hinge part.

12. The arrangement of claim 11, wherein the rotation orientation means comprise a groove defined in the one side of the first hinge part, the recess for the guide member of the first attachment piece being defined in the groove, the groove having a sidewall defining the groove;

the guide device including an element for cooperating with the sidewall of the groove for holding the guide device against rotation with respect to the first hinge part and serving as the means for rotationally fixed mounting of the guide device to the first hinge part.

13. A hinge arrangement for pivotally suspending a movable part on a fixed part;

the hinge arrangement comprising a pivot hinge, a first hinge part extending away from the pivot hinge for being connected to the movable part and a second hinge part extending away from the pivot hinge for being connected to the fixed part;

a guide device for detachably connecting the second hinge part to the fixed part in a fixed position relative to the fixed part, the guide device being fixable to the fixed part in a preset position; while remaining together with the second hinge part, the guide device being separable from the fixed part;

the guide device including a guide member, the guide member and the fixed part having respective formations thereon which enable the guide device together with the second hinge part to be guided to and remounted on the previously set position on the fixed part for enabling the movable part to be separated from the fixed part and thereafter to be remounted on the fixed part in a position that had been set before separation;

groove rotation orientation means on the guide device for rotationally fixing the orientation of the guide device with respect to the fixed part.

14. The arrangement of claim 13, further comprising a first attachment piece on the guide device, a first opening in the fixed part into which the first attachment piece extends; and a first attachment member for cooperating with the first attachment piece for fixing the guide device on the fixed part.

15. The arrangement of claim 14, further comprising a second attachment piece on the guide device, the second hinge part having a second opening therein into which the second attachment piece extends, the second attachment piece and the second opening in the second hinge part being respectively so shaped that there is play between them, permitting lateral shifting of the guide device with respect to the second hinge part; and a second attachment member for fixing the second hinge part to the second attachment piece.

16. The arrangement of claim 15, wherein each of the first and second attachment pieces comprises a screwthreaded bolt, the respective first and second attachment members comprise a first and a second nut, for respectively cooperating with the first and second bolts.

17. The arrangement of claim 15, wherein the first attachment piece has further defined on it the guide member including the formation for guiding the guide device onto a predetermined fixed position on the fixed part, and the fixed part having the formation thereof in the form of a recess therein in which the guide member of the first attachment piece is received for fixing the guide device and the fixed part in fixed relative positions.

18. The arrangement of claim 17, wherein the recess in the fixed part comprises a conical recess which opens wider toward the one side of the hinge part toward which the guide device is disposed and the guide member formation comprises a conically shaped part for being received in the conical recess for orienting the guide device with respect to the fixed part.

19. The arrangement of claim 18, wherein the second hinge part bears against the one side of the fixed part when the guide device is secured to the fixed part.

20. The arrangement of claim 18, further comprising rotation orientation means on the guide device and on the fixed part for rotationally fixing the orientation of the guide device with respect to the fixed part.

21. The arrangement of claim 20, wherein the rotation orientation means comprise a groove defined in the one side of the fixed part, the recess for the guide member of the first attachment piece being defined in the groove, the groove having a sidewall defining the groove;

the guide device including an element for cooperating with the sidewall of the groove for holding the guide device against rotation with respect to the fixed part and serving as the means for rotationally fixed mounting of the guide device to the fixed part.

22. The arrangement of claim 15, further comprising an additional attachment device for connecting the fixed part and the second hinge part, in addition to the guide device.

23. The arrangement of claim 22, wherein the fixed part has a threaded opening therein, the additional attachment device comprises a screw form device for being screwed into the threaded opening in the fixed part, and the second hinge part having an opening therethrough through which the screw form device passes, the opening in the second hinge part being sized so that the screw form device passes through the second hinge part opening with play, enabling the second hinge part to be adjusted with respect to the screw form device and the fixed part for setting the initial orientation of the guide device with respect to the fixed part and the second hinge part.

* * * * *